US006112344A

United States Patent [19]

Guenther

[11] Patent Number: 6,112,344

[45] Date of Patent: Sep. 5, 2000

[54] GRAB BAR

[75] Inventor: Torbett B. Guenther, Plymouth, Mich.

[73] Assignees: Torbett Guenther; Dolores Guenther, both of Plymouth, Mich.

[21] Appl. No.: 09/199,825

[22] Filed: Nov. 25, 1998

[51] Int. Cl.[7] ..... A47K 3/02

[52] U.S. Cl. ..... 4/576.1; 248/222.51; 248/251

[58] Field of Search ..... 4/576.1, 577.1; 211/105.1, 105.2; 248/220.21, 222.14, 222.51, 231.9, 251

[56] References Cited

U.S. PATENT DOCUMENTS

| | | | |
|---|---|---|---|
| 942,564 | 12/1909 | Ireland | 248/222.51 |
| 1,356,675 | 10/1920 | Weir | 248/251 |
| 1,665,785 | 4/1928 | Illch | 248/222.51 X |
| 2,242,461 | 5/1941 | Fisher | 4/576.1 |
| 2,640,672 | 6/1953 | Bedford, Jr. | 248/222.51 |
| 2,736,904 | 3/1956 | Suggs | 4/577.1 |
| 4,319,531 | 3/1982 | Caldwell | 108/52 |
| 5,050,252 | 9/1991 | Cuttriss | 4/576.1 |
| 5,149,037 | 9/1992 | Smith | 248/216.1 |
| 5,647,566 | 7/1997 | Kump | 248/220.21 |

*Primary Examiner*—Robert M. Fetsuga

*Attorney, Agent, or Firm*—Reising, Ethington, Barnes, Kisselle, Learman & McCulloch, P.C.

[57] ABSTRACT

A grab bar is mounted on a wall by a pair of hangers. Each hanger is generally L-shaped with the inner leg thereof inserted through a hole in the wall to extend upwardly along the inner surface of the wall and the outer leg projecting away from the outer surface of the wall. The grab bar is mounted on the outer legs of the hangers. The grab bar is tubular and has internal support members in the form of washers to which the outer legs of the hangers are secured. Screws extending through the wall secure the inner legs of the hangers to the inner surface of the wall. Flanges on the outer legs of the hangers are pressed against the outer surface of the wall by the same screws that secure the inner legs.

15 Claims, 2 Drawing Sheets

GRAB BAR

This invention relates generally to grab bar assemblies and more particularly to a grab bar assembly for assisting persons using a bath tub, shower, jacuzzi or the like.

BACKGROUND AND SUMMARY

A grab bar is typically mounted on a wall adjacent to a bathtub or other bathroom facility. One of the problems is to install the grab bar to an existing wall surface with sufficient rigidity and load-supporting capability to bear the weight of an individual during use. The grab bar should also be capable of being quickly and easily assembled and installed.

In accordance with the present invention, the grab bar is supported by a hanger or hangers which preferably are generally L-shaped, having an inner leg adapted to be inserted through a hole in the wall to extend along the inner surface of the wall, and an outwardly projecting outer leg to which the grab bar is secured. A fastener extends through the wall and secures the inner leg of each hanger firmly against the inner surface of the wall. Preferably, a flange on the outer leg of each hanger engages the outer surface of the wall, and the fastener used to secure the inner leg against the inner surface of the wall also secures the flange against the outer surface of the wall.

Preferably, the grab bar is tubular and the outer legs of the hanger extend through holes in the grab bar and are secured to washers within the grab bar. The washers have peripheral portions to internally support the grab bar. The outer legs of the hangers are secured to the washers by fasteners which are accessible through the open ends of the grab bar. Removable caps close the ends of the grab bar.

One object of this invention is to provide a grab bar assembly having the foregoing features and capabilities.

Another object is to provide a grab bar assembly which is sufficiently rigid and load-supporting to bear the weight of an individual during use, which is of simple construction and which can be readily and easily assembled and installed.

These and other objects features and advantages of the invention will become more apparent as the following description proceeds, especially when considered with the accompanying drawings.

DETAILED DESCRIPTION OF THE PREFERRED EMBODIMENT

Figure 1:
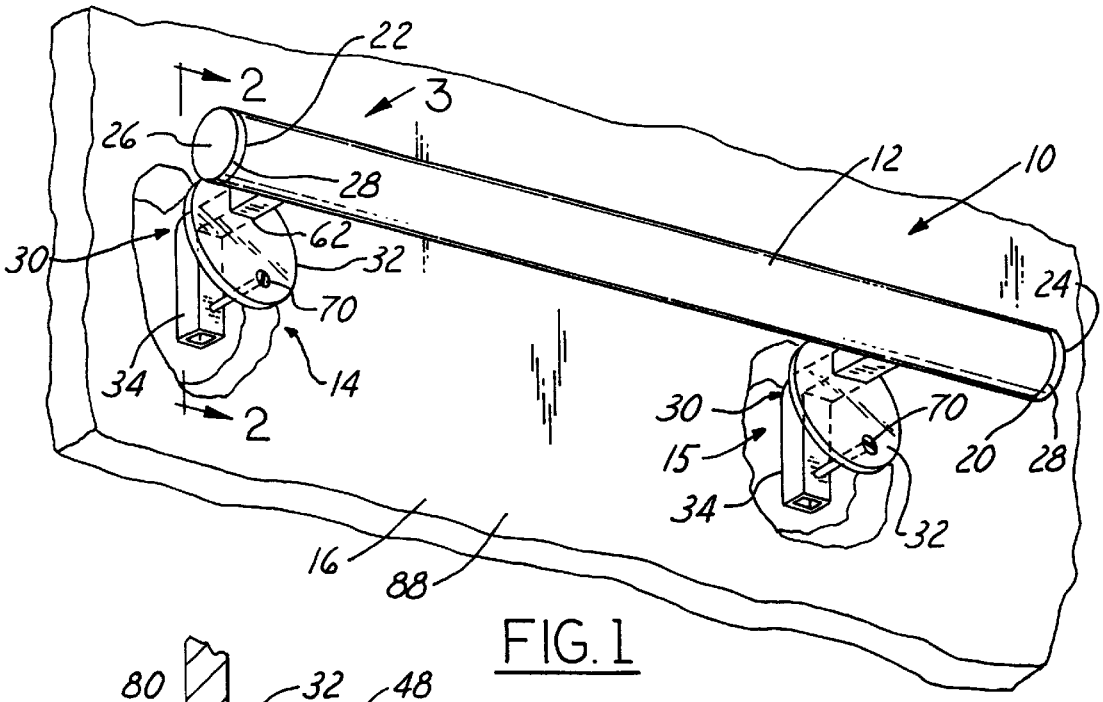
FIG. 1 is a fragmentary perspective view with parts broken away, showing a grab bar assembly constructed in accordance with the invention mounted on an existing wall.
Figure 2:
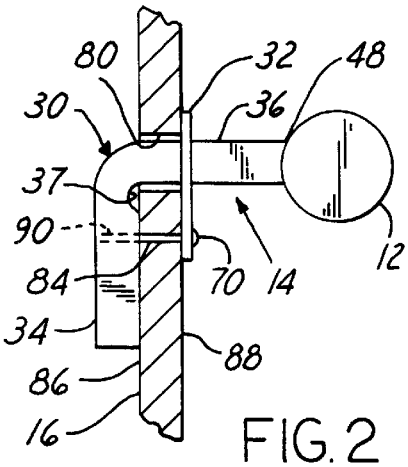
FIG. 2 is a sectional view taken on the line 2—2 in FIG. 1.

Referring now more particularly to the drawings, a grab bar assembly 10 is shown, comprising an elongated, tubular, cylindrical grab bar 12 and laterally spaced apart hanger assemblies 14 and 15 at opposite ends of the grab bar for mounting the grab bar on an existing vertical wall 16.

The grab bar 12 has an inner surface 18 which is of uniform circular cross-section throughout its length, with open ends 20 and 22. Removable end caps 24 and 26 close the ends 20 and 22. The caps are cup-shaped, each having a cylindrical flange 28 which slips over an end of the grab bar.

The hanger assemblies 14 and 15 are identical. Each hanger assembly includes a hanger 30 and a flange 32. The hanger 30 is L-shaped, having an inner leg 34 and an outer leg 36 preferably at right angles to one another. The hanger is preferably of rectangular cross section. A relief 37 at the inside of the corner between the two legs assists in the installation of the hanger as will be more clearly understood later in this description.

Figure 3:
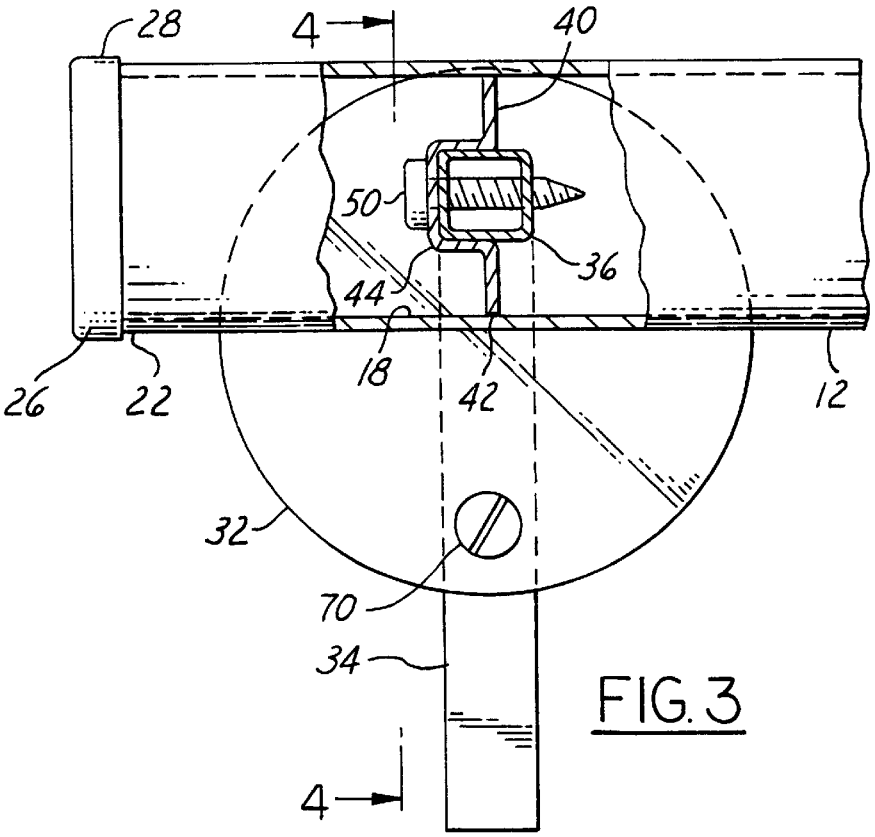
FIG. 3 is an enlarged fragmentary view, with parts in section, looking in the direction of the arrow 3 in FIG. 1.
Figure 4:
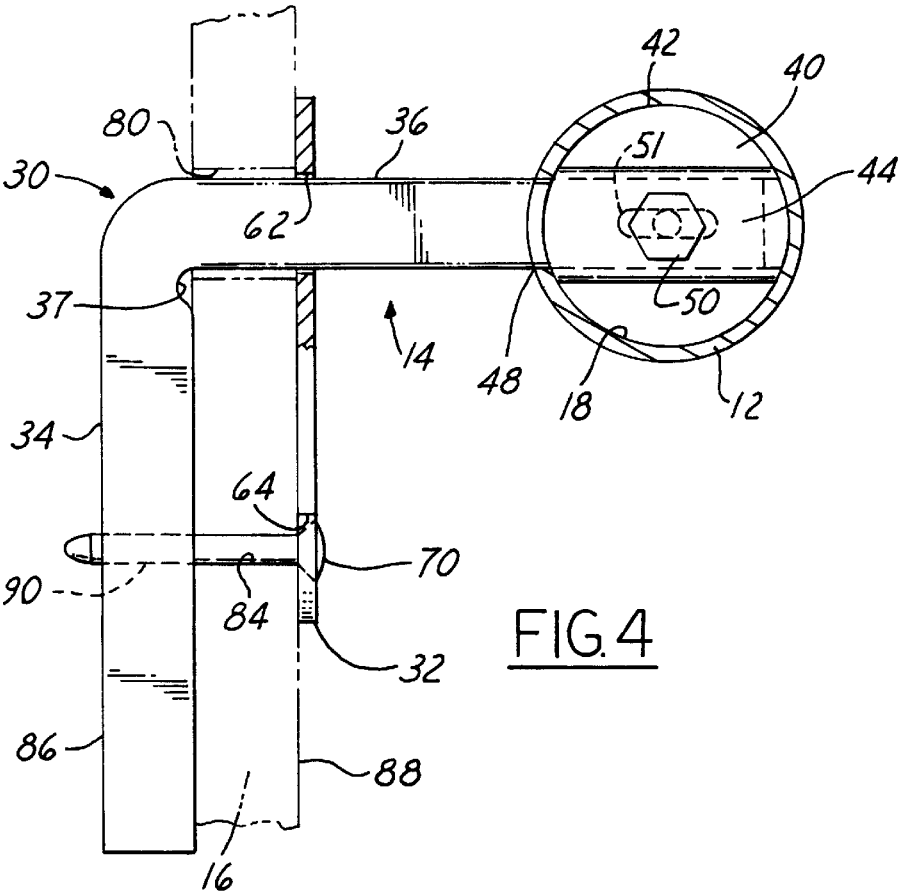
FIG. 4 is an enlarged view similar to FIG. 2, illustrating the connection between the grab bar and a hanger.

Washers 40 are positioned inside the grab bar near each end thereof. Each washer 40 is preferably perpendicular to the lengthwise dimension of the grab bar and has a circular periphery 42 which engages and supports the inner surface 18 of the grab bar. Each washer has a transverse channel 44 midway between the opposite side edges. The outer leg 36 of each hanger extends through an opening 48 in the grab bar and is received in the channel 44 of the associated washer. A fastener 50, preferably a screw, is provided to secure each washer 40 to the outer end portion of the outer leg 36 of each hanger. The fastener 50 extends through the base of the channel 44 and threads into an elongated slot 51 in the outer leg 36 of the associated hanger to secure the washer 40 to the outer leg. By removing the end cap 24 or 26, the screw 50 becomes accessible and can be installed by a screwdriver inserted into the open end of the grab bar. FIGS. 3 and 4 show the connection of the washer 40 and hanger 30 at one end of the grab bar. It will be understood that the connection of the washer and hanger at the other end of the grab bar will be a mirror image of that shown.

The flange 32 of each hanger assembly is in the form of a circular plate that has a rectangular hole 62. The hole 62 is slightly offset from the center of the plate and slidably receives the outer leg 36 of the hanger. The flange 32 also has a second smaller hole 64 for receiving a fastener 70 preferably in the form of a screw.

Figure 5:
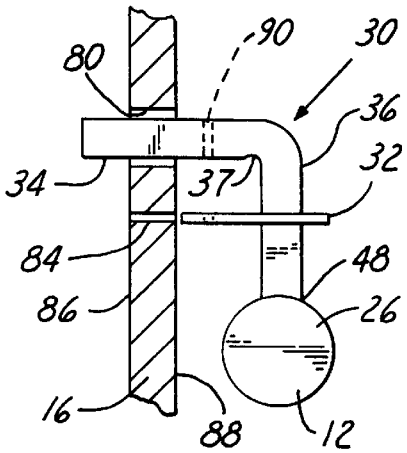
FIG. 5 is a view partly in section showing a hanger in the process of being installed on an existing wall.
Figure 6:
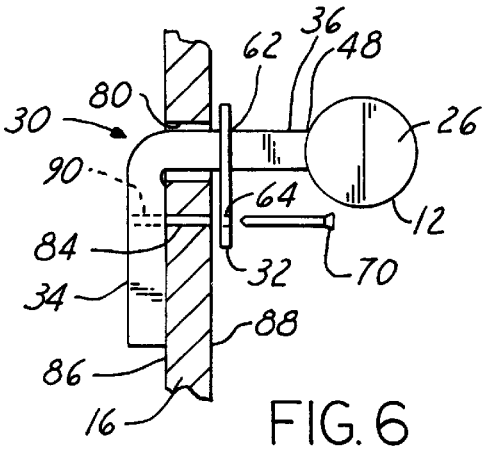
FIG. 6 is a view similar to FIG. 5, but shows the hanger in its final installed position.

To mount the grab bar assembly on the wall 16, two holes 80 are drilled through the wall 16 in laterally spaced apart relation corresponding to the distance between the hangers 30. The holes 80 are slightly larger than the maximum cross-section of the hangers so that the inner legs of the hangers may be inserted as shown in FIGS. 5 and 6. A smaller diameter hole 84 is also drilled through the wall 16 at a point above each larger hole to receive the screw 70. The spacing between the larger hole 80 and the smaller hole 84 corresponds to the distance between the holes 62 and 64 in the flange 32.

The inner legs 34 of the hangers 30 are inserted into the two holes 80 as shown in FIG. 5 and then rotated as in FIG. 6 so that the inner legs project vertically upward and press flat against the inner surface 86 of the wall. The relief 37 at the inner corner of each of the hangers facilitates the entry of the inner legs of the hangers into the holes 80 in the wall and the rotation of the hangers to the FIG. 6 position. The flange 32 of each hanger 30 is then pushed against the outer surface 88 of the wall, and the screw 70 is inserted through the hole 64 in the flange, through the drilled hole 84 in the wall and into a pre-tapped hole 90 in the inner leg 34 of the hanger. When the screws 70 are tightened, the inner legs 34 of the hangers are drawn up tightly against the inner surface 86 of the wall and the flanges 32 are drawn up tightly against the outer surface 88.

Preferably, the grab bar is attached to the outer legs 36 of the hangers 30 prior to mounting the hangers on the wall, although if desired, the grab bar may be mounted on the outer legs of the hangers after the hangers have been mounted on the wall.

What is claimed is:

1. A grab bar assembly for use in combination with a wall having inner and outer surfaces, comprising, a grab bar, means for mounting said grab bar on the wall, said mounting means comprising at least one hanger, said hanger being generally L-shaped having an inner leg and an outer leg extending from an end of said inner leg at a substantial angle, said inner leg of said hanger being adapted to be inserted through a hole in the wall and to extend along the inner surface of the wall with the outer leg of said hanger projecting outwardly and away from the outer surface of the wall, a fastener adapted to extend through the wall and secure the inner leg of the hanger to the inner surface of the wall, and means for securing said grab bar to the outer leg of said hanger.

2. A grab bar assembly as in claim 1, and further including a flange on the outer leg of said hanger to engage the outer surface of the wall, said fastener securing the inner leg of the hanger to said flange.

3. A grab bar assembly as in claim 2, wherein the outer leg of said hanger extends through a hole in said flange.

4. A grab bar assembly as in claim 2, wherein said flange is mounted on the outer leg of said hanger for sliding movement lengthwise thereof.

5. A grab bar assembly as in claim 2, wherein the outer leg of said hanger has an outer end portion on which said grab bar is mounted, and the outer leg extends freely through a hole in said flange enabling adjustment of said flange toward and away from said grab bar prior to being secured to said inner leg by said fastener.

6. A grab bar assembly as in claim 5, wherein said fastener is a screw adapted to extend through a second hole in said flange and thread into a pre-tapped hole in the inner leg of said hanger.

7. A grab bar assembly adopted to be mounted on a wall comprising, an elongated tubular grab bar, means for mounting said grab bar on the wall comprising at least one hanger, said hanger having a leg adapted to extend outwardly from the wall and having an outer end portion, means for securing said grab bar on the outer end portion of said leg, said securing means comprising an internal support member inside said grab bar, the outer end portion of said leg extending into said grab bar through an opening therein, and means securing said internal support member to the outer end portion of said leg.

8. A grab bar assembly as in claim 7, wherein said internal support member comprises a washer having a peripheral portion internally supporting said grab bar.

9. A grab bar assembly as in claim 8, wherein said grab bar has an open end, said means securing said washer to the outer end portion of the leg of said hanger comprises a fastener, said fastener being accessible through said open end of said grab bar, and a removable cap closing the open end of said grab bar.

10. A grab bar assembly as in claim 9, wherein said washer has a transverse channel receiving the outer end portion of the leg of said hanger.

11. A grab bar assembly for use in combination with a wall having inner and outer surfaces comprising, an elongated tubular grab bar, means for mounting said grab bar on the wall comprising laterally spaced apart hangers, each of said hangers being generally L-shaped having an inner leg and an outer leg extending from an end of said inner leg at substantially a right angle, the inner legs of said hangers being adapted to be inserted through spaced apart holes in the wall and to extend along the inner surface of the wall with the outer legs of said hangers projecting outwardly and away from the outer surface of the wall, a screw for each of said hangers, one such screw adapted to extend through the wall and secure the inner leg of one of said hangers to the inner surface of the wall and the other of such screws adapted to extend through the wall and secure the inner leg of the other of said hangers to the inner surface of the wall, means for securing the grab bar to the outer end portion of the outer leg of each of said hangers, said securing means comprising internal support members disposed inside said grab bar in laterally spaced apart relation, the outer end portions of the outer legs of said hangers extending into the grab bar through spaced openings therein, and means securing the outer end portions of the outer legs of said hangers to said respective internal support members.

12. A grab bar assembly as in claim 11, and further including a flange for each of said hangers, one such flange having a hole slidably receiving the outer leg of one of said hangers to engage the outer surface of the wall, the other of such flanges having a hole slidably receiving the outer leg of the other of said hangers to engage the outer surface of the wall, said screws engaging said flanges to press said flanges against the outer surface of the wall.

13. A grab bar assembly as in claim 12, wherein each of said screws extends through additional holes in said flanges and thread into pretapped holes in the inner legs of said hanger.

14. A grab bar assembly as in claim 11, wherein said grab bar has open ends, said means securing the outer end portions of the outer legs of said hangers to said internal support members comprise screws accessible through the open ends of said grab bar, and removable end caps closing the open ends of the grab bar.

15. A grab bar assembly as in claim 14, where said internal support members are in the form of washers, and said washers have transverse channels receiving the outer end portions of the legs of said hangers.

* * * * *